US005799828A

United States Patent [19]

Crawford

[11] Patent Number: 5,799,828

[45] Date of Patent: Sep. 1, 1998

[54] WATER GUN

[75] Inventor: Alan D. Crawford, Burbank, Calif.

[73] Assignee: Robert A. Demars, Woodland Hills, Calif.

[21] Appl. No.: 810,350

[22] Filed: Mar. 3, 1997

[51] Int. Cl.[6] ..... A63H 3/18

[52] U.S. Cl. ..... 222/79; 222/207; 222/386; 446/475

[58] Field of Search ..... 222/79, 207, 386, 222/464.1, 517; 446/405, 473, 475

[56] References Cited

U.S. PATENT DOCUMENTS

| | | | |
|---|---|---|---|
| 2,802,298 | 8/1957 | Larin | 46/8 |
| 2,877,931 | 3/1959 | Goldfarb | 222/79 |
| 4,257,460 | 3/1981 | Paranay et al. | 141/26 |
| 4,735,239 | 4/1988 | Salmon et al. | 141/25 |
| 4,854,480 | 8/1989 | Shindo et al. | 222/79 |
| 4,867,208 | 9/1989 | Fitzgerald et al. | 141/18 |
| 5,064,095 | 11/1991 | Camerino | 222/99 |
| 5,150,819 | 9/1992 | Johnson et al. | 222/79 |
| 5,174,477 | 12/1992 | Schafer | 222/183 |
| 5,339,987 | 8/1994 | D'Andrade | 222/79 |
| 5,598,950 | 2/1997 | Liu et al. | 222/207 |

*Primary Examiner*—Joseph Kaufman
*Attorney, Agent, or Firm*—Jack C. Munro

[57] ABSTRACT

A water gun which utilizes a piston movable within a piston cylinder by a manually operated handle. Movement of the piston to a retracted position within the piston cylinder will result in supplying water from a water reservoir into the piston cylinder. Moving of the piston in an inward position within the piston cylinder will result in expelling water from the piston cylinder into an elastic bladder. The quantity of water being expelled from the piston cylinder within the elastic bladder will cause the elastic bladder to expand substantially, and at the point of full inward motion of the piston, the handle will come into contact with a discharge valve which will be moved to cause release of the water that is confined within the elastic bladder. This water is to be expelled through a nozzle to be emitted into the ambient in a form of a stream.

15 Claims, 2 Drawing Sheets

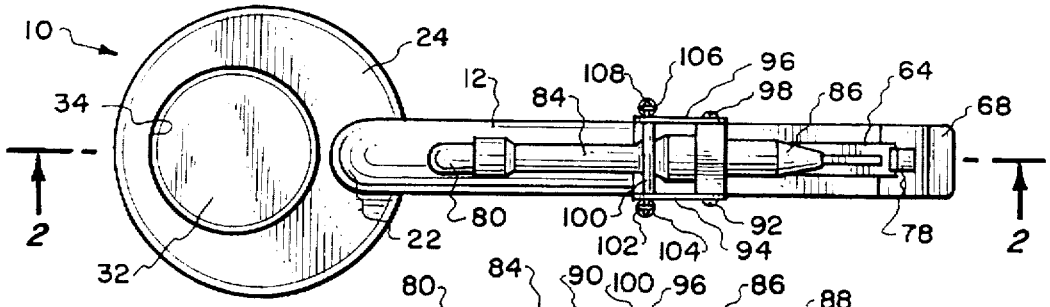
Fig. 1.
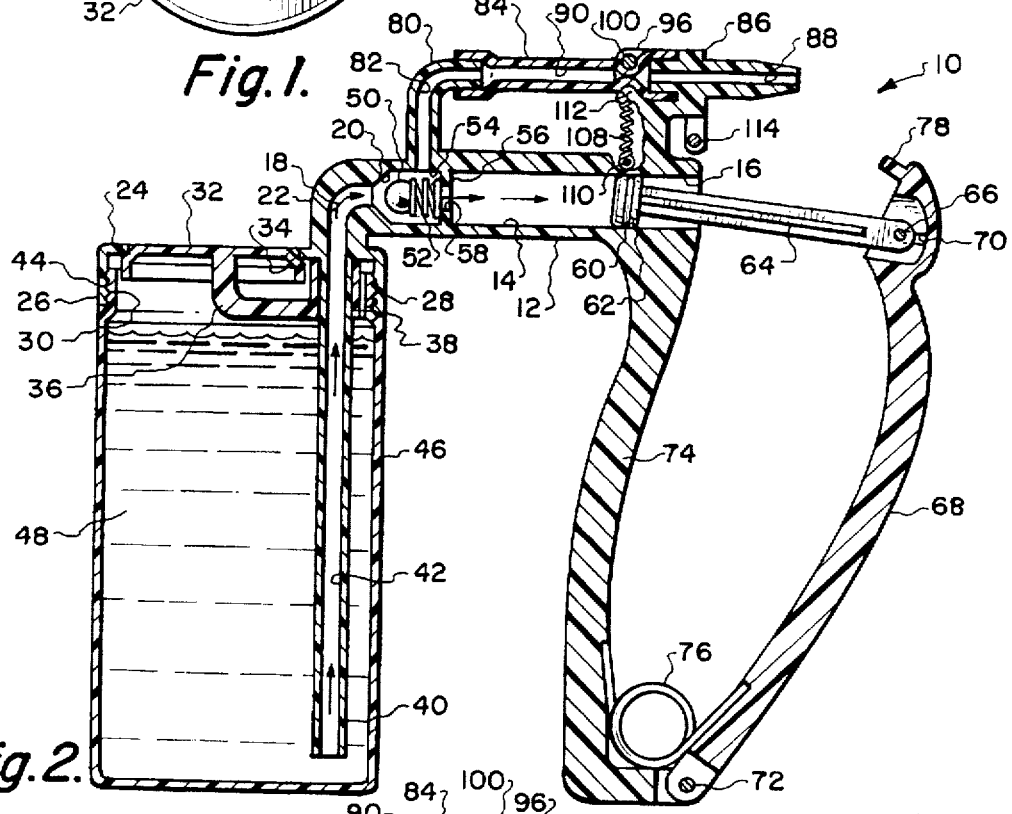
Fig. 2.
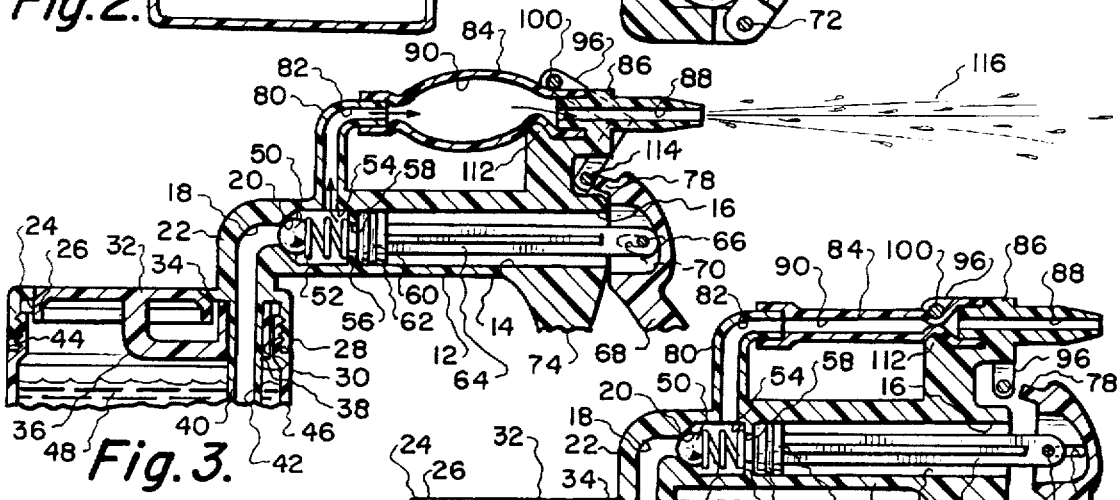
Fig. 3.
Fig. 4.

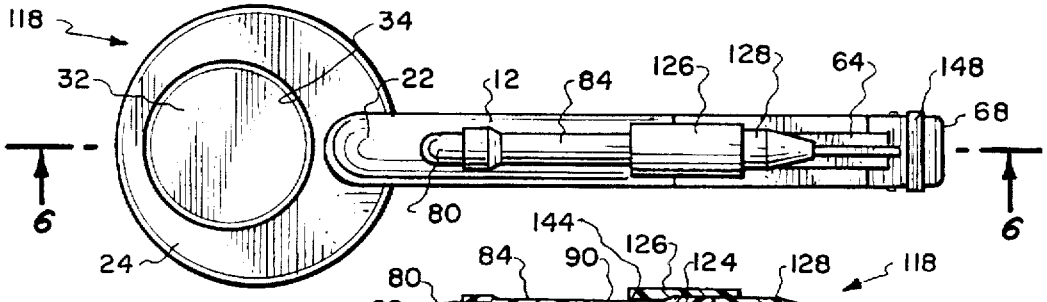
Fig. 5.
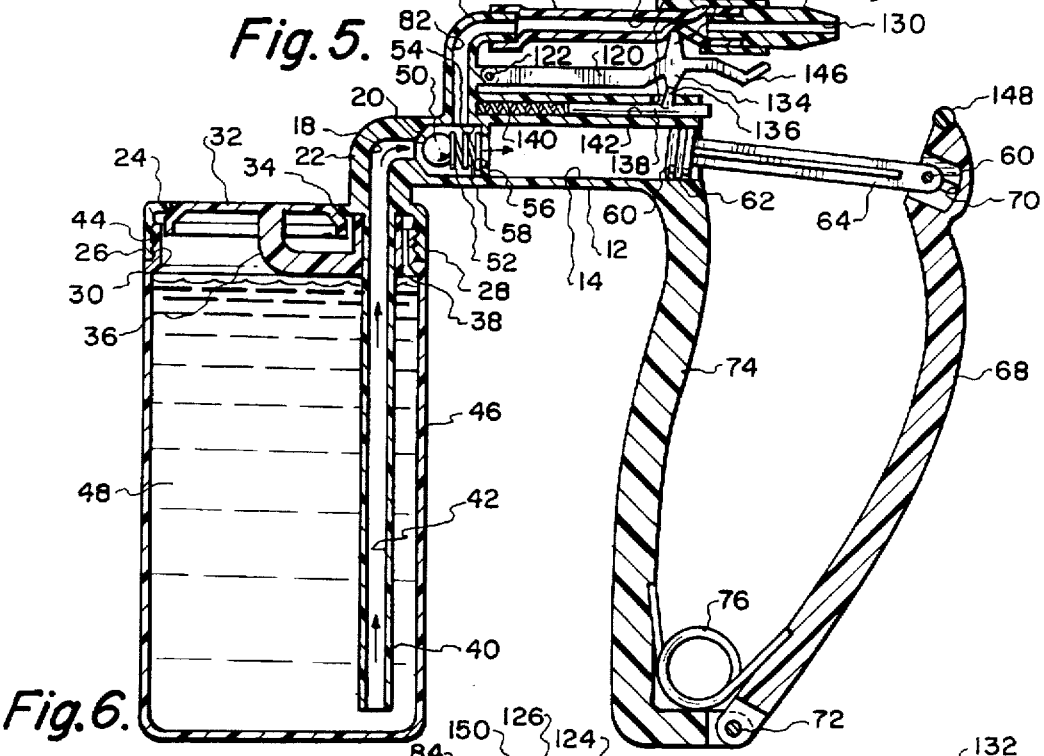
Fig. 6.
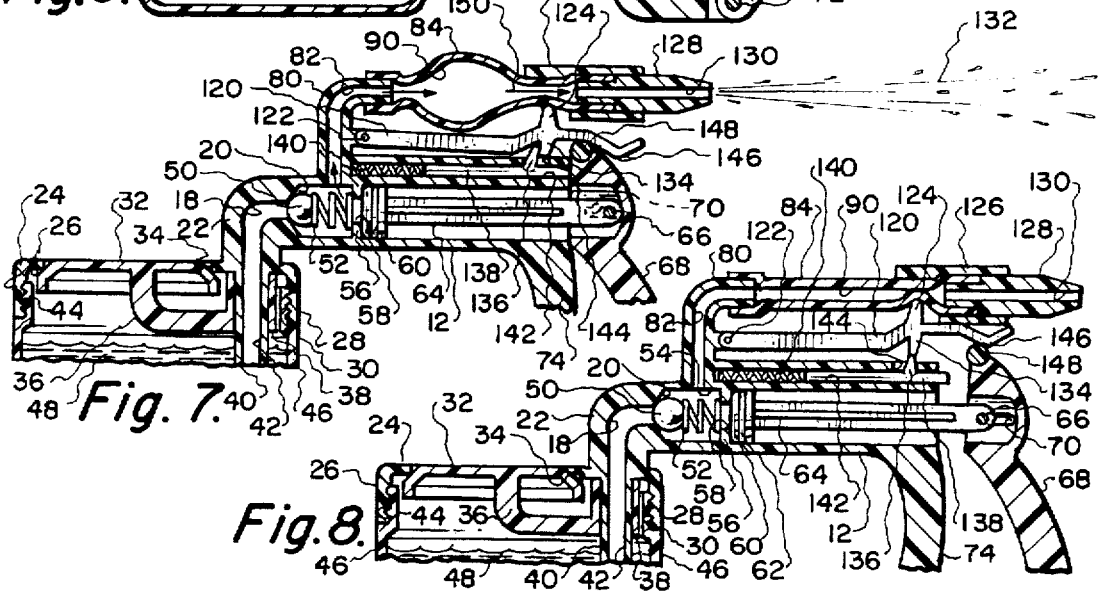
Fig. 7.
Fig. 8.

WATER GUN

BACKGROUND OF THE INVENTION

1) Field of the Invention

The field of this invention relates to water guns and more particularly to a water gun that is capable of placing water under pressure and dispensing of the water at a high velocity a substantial distance into the ambient.

2) Description of the Prior Art

Water guns have long been known. The prior art water guns usually include a hollow housing fashioned in the shape of a rifle or pistol. The housing is designed to hold a quantity of water. A trigger on the housing is typically connected to a pump built into the housing. Movement of the trigger causes a small amount of water to be forced outwardly through a nozzle that is mounted on the housing. However, water guns which utilize a pump type trigger suffer from a drawback in that the power available to expel the water is necessarily less than that which can be supplied by the trigger finger of the user and thus the shooting range and the volume of water expelled are quite limited.

To increase the pressure and volume of water released, some have proposed that an external energy source could be used such as a battery or a cylinder of compressed gas. Obviously, this would add to the complexity and cost of the water gun and make it less convenient to use and possibly make it unsafe.

A more practical method of increasing volume and range of a water gun has been successfully marketed in which the user can store energy by using a manually operated pump to compress air within a chamber in the water gun. The compressed air can then force a copious quantity of water out the nozzle when a valve is opened by a trigger. One disadvantage of this system is that it is relatively complex, having to deal with compressed air and water. Also, the act of compressing the air requires a large pump which makes the toy bulky and adds to the cost. Also, in order to build up sufficient pressure, it takes many strokes of the pump which diminishes the fun of the toy. Further, continued pumping could lead to an unsafe internal pressure.

Another way to store energy that has been proposed is to use an elastic bladder, such as a length of latex rubber tubing, to store pressurized water. This eliminates the need to pressurize air which is used as the propelling medium. However, there is a problem with pressurized water being supplied to a latex bladder in that if the bladder is subjected to excessive pressure, it will rupture. This problem of excessive pressure has been addressed in the prior art by adding a pressure relief valve. Also, the prior art relies on an external pressurized water source, such as household tap water, to fill the elastic bladder, which is inconvenient.

SUMMARY OF THE INVENTION

A water gun toy comprising a housing, a water reservoir, a check valve, a pump which comprises a piston and cylinder, an elastic bladder, a discharge valve, and a nozzle. Connected with the housing is the water reservoir in the form of a water container for supplying water to the water gun. The pump, which comprises the piston mounted in a piston cylinder, is mounted within the housing with the water from the reservoir to be conducted past a one-way valve into the piston cylinder. The user squeezes a handle pivotally connected to the piston which forces water through a conduit into the elastic bladder thereby pressurizing it. The outlet from the bladder is normally closed by a discharge valve. At the end of the travel of the handle, the discharge valve is opened which allows the pressurized water to shoot into the ambient out the nozzle. The discharge valve closes the elastic bladder by pinching of the bladder. The lever is returned to its initial position by a spring and in so doing first closes the discharge valve then draws water from the reservoir through the check valve and into the piston cylinder.

The use of a chamber in which pressurized water can be stored allows water to be discharged at a higher rate and pressure than can be done by attaching the outlet of a pump directly to the nozzle which is common in the prior art. In other words, the power output (volume flow rate multiplied by pressure) can exceed the power input (force applied by the user's hand multiplied by the rate of movement). This enhances play value of the water gun since the user can pressurize the water gun in anticipation, then, at the moment of need, will have greater firepower available.

Pressurizing the water directly allows for a more compact and efficient design over a pressurized air/water system due to the fact that water is not compressible. To further facilitate the pressurization process, the preferred embodiment of the present invention utilizes a handle which is squeezed by the user's whole hand as opposed to the trigger on a common squirt gun which is actuated by the index finger alone thus achieving substantially greater force.

Just as a rooster will puff up his chest or a person will cock the hammer on a pistol, the present invention has a way of advertising that the user means business. This is accomplished by placement of the elastic bladder in a prominent position so that when it swells under pressure such is readily observable by everyone in the vicinity making it known that the user is "armed and dangerous."

If, in operation, the handle is not squeezed far enough to open the discharge valve, then on the handle's release, the pressurized water in the elastic bladder will flow back into the piston cylinder and thus depressurize the system. This prevents excessive pressure from occurring.

In order to efficiently discharge the water through the nozzle, the discharge valve must open quickly. The second embodiment of the present invention shows a pinch-type release valve which springs open as opposed to pushing the release valve open as shown in the first embodiment.

The primary objective of the present invention is to provide a water gun toy which is fun to play with in a novel way yet is safe, easily manufactured, compact and durable.

More specifically, an objective of the present invention is to provide a water gun which can store a quantity of water under pressure.

A further objective of the present invention is to allow the water to be pressurized quickly and efficiently.

A further objective of the present invention is to provide a visible indication when the water gun is pressurized.

A further objective of the present invention is to provide a water gun in which the internal pressure is limited to a safe level.

A further objective of the present invention is to provide a discharge valve in conjunction with the water gun which opens rapidly.

BRIEF DESCRIPTION OF THE DRAWINGS

FIG. 1 is a top plan view of the first embodiment of the water gun constructed in accordance with this invention;

FIG. 2 is a cross-sectional view taken along line 2—2 of FIG. 1 of the first embodiment of the water gun of the present invention showing the handle of the water gun being moved in the direction retracting of the piston of the water gun and drawing water from the reservoir to within the piston cylinder;

FIG. 3 is a cross-sectional view similar to FIG. 2 but showing the handle located in its full inward position with the expandable tubular bladder enlarged by a quantity of water and the discharge valve being moved to the open position which is causing the release of water through the nozzle;

FIG. 4 is a cross-sectional view similar to FIG. 3 showing the handle in a position of beginning to retract with the discharge valve now moved again to its closed position and the piston is beginning to retract from its full inward position which will cause water to be drawn from the reservoir into the piston cylinder;

FIG. 5 is a top plan view similar to FIG. 1 but of a second embodiment of water gun of this invention;

FIG. 6 is a cross-sectional view through the water gun taken along line 6—6 of FIG. 5 which is in the same position as FIG. 2;

FIG. 7 is a cross-sectional view of a portion of the second embodiment of water gun of this invention showing the discharge valve in the open position and expelling water which is similar to the position of FIG. 3; and FIG. 8 is a cross-sectional view of the second embodiment of water gun of this invention showing the discharge valve being closed and the piston in a position beginning to retract which is similar to the position shown in FIG. 4.

DETAILED DESCRIPTION OF THE PREFERRED EMBODIMENTS

Referring particularly to the drawings there is shown in FIGS. 1–4 the first embodiment 10 of water gun of this invention. The first embodiment 10 includes a housing 12 which will generally be constructed of a rigid plastic or metal material. Mounted within the housing 12 is a piston cylinder 14. The piston cylinder 14 has an open outer end 16 and an inner end which connects with an inlet passage 18. At the junction of the inlet passage 18 to the piston cylinder 14 there is formed a valve seat 20. The inlet passage 18 is mounted within an inlet conduit 22. The inlet conduit 22 is integrally connected to a cap 24. The cap 24 is annularly shaped which defines an internal recess 26. The sidewall 28 of the cap 24 which encloses the recess 26 includes a series of internal screw threads 30. The threads 30 are threadably secured with external threads 44 of a container 46. Container 46 is to function as a reservoir for water 48.

The cap 24 also includes an air release valve in the form of a disk 32. The disk 32 is mounted within hole 34 formed within the cap 24. The disk 32 is normally maintained in position closing hole 34 by means of arm 36. Arm 36 extends from a sleeve 38. Sleeve 38 surrounds the upper end of a tube 40. Tube 40 extends some distance from the cap 24. The tube 40 has a through passage 42 which connects with the inlet passage 18.

Normally there is mounted a ball 50 in conjunction with the valve seat 20. The ball 50 is normally pressed in connection with the valve seat 20 by means of a coil spring 52. The spring 52 and the ball 50 are actually mounted within forward end 54 of the piston cylinder 14. The back end of the spring 52 abuts against dividing wall 56. Dividing wall 56 includes a center hole 58.

Slidably engaged with the piston cylinder 14 is a piston 60. The piston 60 includes an O-ring 62 which keeps piston 60 in liquid tight contact with piston cylinder 14. The piston 60 is fixedly connected to one end of a rod 64. The outer end of the rod 64 is mounted by a pin 66 to a handle 68. The pin 66 rides within an elongated slot 70 formed within the handle 68. The purpose of the slot 70 will be described further on in the specification. It is to be noted that the rod 64 is capable of a small amount of pivoting movement relative to the handle 68.

The lower end of the handle 68 is mounted by a pin 72 to a fixed handle member 74. The fixed handle member 74 is integrally mounted to the housing and is part of the housing 12. A spring 76 is mounted between the fixed handle member 74 and handle 68. The function of the spring 76 is to exert a continuous bias tending to locate the handle 68 in its outwardly extending position which is shown in FIG. 2 of the drawings. The handle 68 is pivotable relative to fixed handle member 74 thereby resembling a trigger. The upper free end of the handle 68 includes protrusion 78. The function of protrusion 78 will also be explained further on in the specification.

A conduit 80, which has an internal passage 82, is integrally connected to the housing 12 with the passage 82 connecting with forward end 54 of the piston cylinder 14. The outer end of the conduit 80 is mounted on the inner end of a pressure chamber in the form of an elastic bladder 84 such as an expandable tubular bladder. The outer end of the elastic bladder 84 is mounted on nozzle 86. A through passage 88 is formed through the nozzle 86. The elastic bladder 84 has an internal chamber 90. The nozzle 86 is fixedly mounted on a portion of the housing 12.

Pivotally mounted by means of screw 92 to one side of the nozzle 86 is an L-shaped bracket 94. An identical L-shaped bracket 96 is pivotally mounted to the opposite side of the nozzle 86 by means of a screw 98. Connected between the brackets 94 and 96 is a bar 100. One end of the bar 100 is fixedly mounted to the bracket 94 by means of a screw 102. Screw 102 also functions to mount one end of a coil spring 104. The opposite end of the bar 100 is fixedly mounted to the bracket 96 by means of a screw 106. The screw 106 also functions to support the upper end of a coil spring 108. The lower ends of the coil springs 104 and 108 are fixedly mounted to the housing 12 as by means of screw 110 for the spring 108. The mounting for the spring 104 is not shown. The bias of the coil springs 104 and 108 is such that it forces bar 100 against elastic bladder 84 pinching such closed against surface 112 of the housing 12. The outer end of the L-shaped brackets 94 and 96 are connected together by means of a bar 114.

The operation of the first embodiment 10 of this invention is as follows: Let it be assumed that the first embodiment 10 is in the position shown in FIG. 2. The user grasps the fixed handle member 74 and the handle 68 and with the user's hand applies a squeezing motion on the handle 68. This will cause the pin 66 to move to the outer end of the slot 70 and then the rod 64 and the piston 60 will then begin to move inwardly within the piston cylinder 14. Let it be assumed that there is a quantity of water contained within the piston cylinder 14. This quantity of water will be forced through the center hole 58 into the forward end 54 of the piston cylinder 14. The coil spring 52 has located the ball 50 against the valve seat 20 closing off the inlet passage 18. The water is then only able to flow through the passage 82 and into the internal chamber 90 of the elastic bladder 84. As the piston 60 continues to move inwardly within the piston cylinder 14, more and more water continues to move within the internal chamber 90 with exit therefrom being prevented by the bar 100 which has closed off the outer end of the elastic bladder 84. The result is the elastic bladder 84 expands as shown in FIG. 3. At the time piston 60 approaches the dividing wall 56, the protrusion 78 comes into contact with the bar 114. A slight movement of the handle 68 toward the housing 12 will result in the protrusion 78 contacting the bar 114. This will cause both the L-shaped brackets 94 and 96 to pivot in unison lifting the bar 100 from the elastic bladder 84. This will permit the water contained within the internal chamber 90 to be released and passed through the through passage 88 and then expelled as a stream 116 into the ambient.

After the internal chamber 90 has been emptied, the user will begin to release the pressure against the handle 68. The spring 76 will then cause the handle 68 to move away from the fixed handle member 74. The protrusion 78 will then become disengaged from the bar 114 with the result that the springs 104 and 108 will then cause the bar 100 to pinch off and close elastic bladder 84. As the piston 60 moves rearwardly within the piston cylinder 14, there is created a vacuum and this vacuum will cause the ball 50 to be lifted from the valve seat 20. This vacuum will then cause some of the water 48 to be conducted through the through passage 42 of the tube 40 and to be deposited within the piston cylinder 14 completely filling such until the piston 60 gets to its outermost position which is shown in FIG. 2 of the drawings. As water 48 is removed from the container 46, air is caused to enter through hole 34 to be located within the upper end of the container 46. A slight vacuum will be created in this portion of the container 46 which will cause the disk 32 to become slightly unseated from the hole 34. This slight unseating of the disk 32 will be permitted by deflection of the arm 36 which exerts a spring bias against the disk 32 tending to locate disk 32 closing hole 34. Once the piston 60 is back again in the position of FIG. 2, the process can then be repeated.

Another use of disk 32 is that when it is desired to add water 48 into water reservoir 46, a water faucet (not shown) only needs to be pressed against the disk 32 causing such to be displaced from hole 34. Water from the faucet can then flow into water reservoir 46. In essence, disk 32 functions like a spring loaded trap door.

The reason for the slot 70 is that the handle 68 is to become completely disconnected from the bar 114 before the piston 60 starts to move rearwardly. This will prevent air from being drawn within the internal chamber 90 of the elastic bladder 84. The bar 100 will pinch closed the internal chamber of the elastic bladder 84 prior to rearward movement of the piston 60.

Referring particularly to FIGS. 5–8 of the drawings, there is shown the second embodiment 118 of the water gun of this invention. Like numerals have been utilized from the first embodiment 10 of this invention that apply to similar parts of the second embodiment 118. The second embodiment 118 has the same container 46 which has the same air valve disk 32 which includes a tube 40 extending within the container 46. The fluid passage 42 of the tube 40 connects with inlet passage 18 which in turn connects with a check valve in the form of ball 50 and coil spring 52. The ball 50 and coil spring 52 are mounted in the forward end 54 of the piston cylinder 14. A conduit 80 is integrally connected to the housing 12 with the conduit 80 including a passage 82 which connects with the forward end 54. Mounted on conduit 80 is an elastic bladder 84 which includes an internal chamber 90. A piston 60 is slidably mounted within the piston cylinder 14. Mounted on the piston 60 is a rod 64 which is pivotally mounted by means of a pin 66 which rides within slot 70 to a movable handle 68. The movable handle 68 is pivotally mounted by means of pivot pin 72 to the fixed handle member 74. A spring 76 is connected between the fixed handle member 74 and the handle 68 which is movable. The structure that is different within the second embodiment 118 pertains to the valve mechanism to achieve pinching or closing off of the elastic bladder 84. That valve mechanism is as follows:

The valve mechanism utilized in the second embodiment 118 operates in the same manner as the valve mechanism utilized in conjunction with the first embodiment 10. Pinching or closing off of the elastic bladder 84 is accomplished by means of a catch or lever 120 which is pivotally mounted by means of pivot pin 122 to the conduit 80. The lever 120 includes a protuberance 124 which is capable of being pressed tightly and held in that position against the elastic bladder 84, thereby closing of the internal chamber 90 not providing an outlet passage for any liquid contained within chamber 90. The protuberance 124 is to press the elastic bladder 84 against the inner surface of a sleeve 126 which is fixedly mounted to the housing 12. The outer end of the elastic bladder 84 passes through the sleeve 126. The sleeve 126 also functions to support the nozzle 128 which has a through passage 130. The water is to be expelled from the internal chamber 90 through the through passage 130 in the form of a stream 132 into the ambient.

The lever 120 has a protrusion 134 which extends from the underside of the lever 120 where the protrusion 124 extends from the upper side of the lever 120. The protrusion 134 is substantially aligned with the protrusion 124. The protrusion 134 can rest on upstanding member 136 which is fixed to an elongated rod 138. The elongated rod 138 is biased to an outward direction by means of a coil spring 140. The coil spring 140 and elongated rod 138 are mounted within elongated recess 142 formed within the housing 12. The upstanding member 136 is movable a limited distance within hole 144 also formed within the housing 12. The outer free end of the elongated rod 138 is to be contactable by the handle 68. The outer end of the lever 120 includes a cam surface 146. This cam surface 146 is to be contactable by bar 148 which is mounted on the handle 68.

Let it be assumed that there is a quantity of water contained within the piston cylinder 14. The piston 60 is in the retracted position as is shown in FIG. 6. The operator begins to move handle 68 toward fixed handle member 74. Initially the pin 66 will be moved to the outer end of the slot 70 at which time the piston 60 will begin to move within the piston cylinder 14. At this time the ball 50 will seat on the valve seat 20 with the only outlet for the water being through passage 82 into internal chamber 90 of the elastic bladder 84. The upstanding member 136 is positioned against the protrusion 134 with the spring 140 locating the upstanding member 136 at the outer edge of the hole 144. It is to be noted that the hole 144 is oversized. With the upstanding member 136 in contact with the protrusion 134, the protrusion 124 is pressed tightly in contact with the elastic bladder 84 closing off the internal chamber 90.

As the piston continues to move through the piston cylinder 14 and approaches the dividing wall 56, the elastic bladder 84 is expanded, as shown in FIG. 7, because of the quantity of water that is now contained within the internal chamber 90. The handle 68 will then contact the free end of the elongated rod 138 and further movement of the handle 60 will cause elongated rod 138 to be moved against coil spring 140 resulting in upstanding member 136 being disengaged from the protrusion 134. This will cause the lever 120 to fall to the position shown in FIG. 7 which will result in the water contained within internal chamber 90 being permitted to flow in the direction of arrow 150 into the through passage 130 and then forming the stream 132 into the ambient.

Now the user proceeds to release handle 68. What occurs first is the pivot pin 66 will then move to the opposite end of the slot 70 and at this position the handle 68 will then be disengaged from the outer end of the elongated rod 138. The sidewall of the upstanding member 136 will abut against the sidewall of the protrusion 134. This position is clearly shown in FIG. 7 of the drawing. Further outward movement of the handle 68 will now cause the piston 60 to be moved rearwardly within the piston cylinder 14. As this movement occurs, the ball 50 will become unseated from the valve seat 20 and water will be drawn through the through passage 42, through the inlet passage 18 and into the forward end 54 of piston cylinder 14 and through the center hole 58 into the piston cylinder 14. Immediately after the handle 68 becomes separated from the elongated rod 138, the bar 148 will come against the cam surface 146 and as the bar 148 rides over the cam surface 146, the lever 120 will be pivoted in an upward direction resulting in the protrusion 124 again causing the closing of internal chamber 90. This will also locate the protrusion 134 above the upstanding member 136 and the bias of the spring 140 will move the elongated rod 138 to its outward position which will again result in the upstanding member 136 supporting the protrusion 134 which maintains this pinching of the elastic bladder 84 preventing water from being expelled within through passage 130 of the nozzle 128. When the handle 68 is in its outermost position, which is caused by the spring 76, the piston cylinder 14 and the forward end 54 will be substantially filled with water and therefore the handle 68 can then be moved again to a position against the housing repeating the water discharge of the stream 132.

What is claimed is:

1. A water gun comprising:

a housing;

a reservoir mounted on said housing, said reservoir to contain a supply of water;

a piston cylinder formed in said housing, an inlet passage connecting with said piston cylinder, a one-way valve normally closing said inlet passage relative to said piston cylinder, an outlet passage connecting with said piston cylinder;

a piston movably mounted within said piston cylinder;

a handle connected to said piston, said handle being movable between a retracted position and an extended position, said piston being manually moved within said piston cylinder by said handle during movement of said handle between said retracted position and said extended position, said piston being movable in an inward direction and an outward direction, movement of said piston in said outward direction opens said one-way valve and permits water to flow into said inlet passage and into said piston cylinder, movement of said piston in said inward direction causes water to flow from said piston cylinder into said outlet passage with said one-way valve being closed; and an elastic bladder connected with said outlet passage, said elastic bladder having a discharge passage, said discharge passage being normally closed by a discharge valve assembly, said elastic bladder to receive water from said outlet passage which will cause said elastic bladder to expand due to a quantity of water contained within said elastic bladder where said quantity of water exceeds the volume of said elastic bladder in its unexpanded state, said handle to contact said discharge valve assembly causing said discharge valve assembly to move to an open position resulting in discharging of said quantity of water into the ambient.

2. The water gun as defined in claim 1 wherein:

said discharge valve assembly pinching said discharge passage of said elastic bladder when said discharge valve assembly is closed.

3. The water gun as defined in claim 2 wherein:

said discharge valve assembly including an L-shaped frame pivotally mounted on said housing.

4. The water gun as defined in claim 2 wherein:

said outlet passage being located within an outlet conduit, a lever being pivotally mounted on said outlet conduit, said lever including a protrusion, said protrusion to contact said elastic bladder to effect closing of said discharge passage by pinching of said elastic bladder.

5. The water gun as defined in claim 4 wherein:

said lever including a camming surface, said camming surface is to be contacted by said handle as said handle is moved from said extended position towards said retracted position resulting in moving of said lever to the position pinching of said elastic bladder.

6. The water gun as defined in claim 5 wherein:

an elongated rod being movably mounted within said housing, said elongated rod being spring biased to a support position, with said elongated rod in said support position said lever being located in the position closing of said discharge passage, said elongated rod to be contactable by said handle to be moved away from said support position permitting said lever to be moved to open said discharge passage.

7. A water gun comprising:

a housing;

a water reservoir;

a vacuum relief valve mounted on said water reservoir, said vacuum relief valve allowing ambient air to vent into said water reservoir to prevent buildup of vacuum with said water reservoir as water is withdrawn, said vacuum relief valve also prevents unauthorized leakage of water from said water reservoir;

pump means mounted within said housing;

means for operating said pump means;

a one-way valve connecting said water reservoir with said pump means, said one-way valve allowing water to flow from said water reservoir to said pump means but not permitting water to flow from said pump means into said water reservoir;

a pressure chamber connected to said housing, said pressure chamber to receive water, said pressure chamber operates as the internal pressure increases the volume of water in said pressure chamber increases;

a passageway connecting said pump means to said pressure chamber;

a nozzle connecting with said pressure chamber through which pressurized water discharges into the ambient;

a normally closed discharge valve connecting said pressure chamber with said nozzle; and said means for operating also causing said discharge valve to open.

8. The water gun as defined in claim 7 wherein:

said vacuum relief valve also comprising a means for filling said water reservoir with water, said vacuum relief valve comprises a spring loaded trap door which when displaced allows said water reservoir to be quickly filled with water.

9. The water gun as defined in claim 7 wherein:

said pump means consists of at least one piston movable within a cylinder.

10. The water gun as defined in claim 7 wherein:

said means for operating said pump means consists of a handle pivotally attached to said housing which is to be moved toward said housing by the user's hand.

11. The water gun as defined in claim 7 wherein:

said pressure chamber consists of an elastic bladder.

12. The water gun as defined in claim 11 wherein:

said discharge valve closes one end of said elastic bladder by pinching closed the one end of said elastic bladder by a spring loaded member.

13. The water gun as defined in claim 10 wherein:

said handle connecting with said discharge valve near the end of movement of said handle causing said discharge valve to be opened.

14. The water gun as defined in claim 10 wherein:

said discharge valve comprises a rigid member held by a mechanical catch in a position closing of said elastic bladder.

15. The water gun as defined in claim 14 wherein:

said mechanical catch being moved to release said rigid member by said handle when said handle is located nearest said housing and is reset to its closed position by said handle as said handle is moved back to its at rest position.

* * * * *